US006817897B2

(12) United States Patent
Chee

(10) Patent No.: US 6,817,897 B2
(45) Date of Patent: Nov. 16, 2004

(54) END CONNECTOR FOR COAXIAL CABLE

(76) Inventor: Alexander B. Chee, 2789 Pine Meadow Dr., Marietta, GA (US) 30066

( * ) Notice: Subject to any disclaimer, the term of this patent is extended or adjusted under 35 U.S.C. 154(b) by 0 days.

(21) Appl. No.: 10/673,690

(22) Filed: Sep. 29, 2003

(65) Prior Publication Data

US 2004/0102089 A1 May 27, 2004

Related U.S. Application Data

(60) Provisional application No. 60/432,798, filed on Dec. 11, 2002, and provisional application No. 60/420,307, filed on Oct. 22, 2002.

(51) Int. Cl.[7] ..... H01R 9/05
(52) U.S. Cl. ..... 439/578
(58) Field of Search ..... 439/578, 583, 439/584, 585, 528, 683, 350

(56) References Cited

U.S. PATENT DOCUMENTS

| | | | | | |
|---|---|---|---|---|---|
| 4,834,675 | A | | 5/1989 | Samchisen | 439/578 |
| 5,342,218 | A | | 8/1994 | McMills et al. | 439/578 |
| 5,863,220 | A | | 1/1999 | Holliday | 439/584 |
| 6,089,913 | A | | 7/2000 | Holliday | 439/584 |
| 6,153,830 | A | * | 11/2000 | Montena | 174/88 C |
| 6,163,830 | A | | 12/2000 | Nguyen et al. | 711/119 |
| 6,179,656 | B1 | * | 1/2001 | Wong | 439/578 |
| D437,826 | S | | 2/2001 | Montena | D13/133 |
| 6,210,222 | B1 | * | 4/2001 | Langham et al. | 439/583 |
| 6,217,383 | B1 | * | 4/2001 | Holland et al. | 439/578 |
| 6,241,553 | B1 | | 6/2001 | Hsia | 439/578 |
| D468,696 | S | | 1/2003 | Montena | D13/151 |
| 6,558,194 | B2 | * | 5/2003 | Montena | 439/585 |
| 6,592,403 | B2 | * | 7/2003 | Kooiman | 439/578 |
| 6,676,446 | B2 | | 1/2004 | Montena | 439/583 |

* cited by examiner

*Primary Examiner*—Ross Gushi
*Assistant Examiner*—Phuongchi Nguyen
(74) *Attorney, Agent, or Firm*—Morris, Manning & Martin; Tim Tingkang Xia

(57) ABSTRACT

A fitting member for connecting a coaxial cable having an electrically conductive member to a second electrically conductive member. In one embodiment of the present invention, the fitting member comprises a connector body, an outer tube mounted to the connector body, an inner tube having a tube body for receiving a free end of the electrically conductive member of the coaxial cable therethrough, wherein the tube body comprises a neck portion, a flange extending from the neck portion, a first shoulder extending from the flange, a second shoulder extending from the first shoulder for engaging with the outer tube, a first step formed at the junction of the second shoulder and the first shoulder so as to limit the axial motion of the outer tube, a second step formed at the junction of the first shoulder and the flange, a third step formed at the junction of flange and the neck portion, and a sleeve tube insertable into the connector body for holding the coaxial cable.

7 Claims, 4 Drawing Sheets

END CONNECTOR FOR COAXIAL CABLE

CROSS-REFERENCE TO RALATED PATENT APPLICATION

This application claims the benefit, pursuant to 35 U.S.C. §119(e), of provisional U.S. patent application Ser. No. 60/432,798, filed Dec. 11, 2002 entitled "END CONNECTOR FOR COAXIAL CABLE," and provisional U.S. patent application Ser. No. 60/420,307, filed Oct. 22, 2002 entitled "END CONNECTOR FOR COAXIAL CABLE," the disclosure for each of which is hereby incorporated herein in its entirety by reference.

BACKGROUND OF THE INVENTION

1. Field of the Invention

The present invention generally relates to a fitting member, and more particularly, to a fitting member for connecting a coaxial cable having an electrically conductive member to a second electrically conductive member.

2. The Background

Various types of end connectors are known in the art. Conventional end connectors are typically threaded onto a complimentary interface connector to mechanically and electrically connect a coaxial cable to various electronic devices.

There are several disadvantages with the conventional end connectors. A primary function of an end connector is to ensure good engagement between corresponding elements of the coaxial cable and the end connector body for electrical signal transmission. For a highly braided coaxial cable, the insertion of the coaxial cable into the conventional end connector body may cause an outer jacket and/or a braided conductor of the coaxial cable to be damaged and/or disorientated. Additionally, as the coaxial cable is inserted into the conventional end connector, the electrical cord of the coaxial cable is often twisted. This may result in degraded electrical signal transmission performance and/or degradation.

Another drawback with the conventional end connectors is moisture infiltration that may get into the end connector body from the space between the end connector body and the coaxial cable, and/or from the space between the end connector body and the interface connector.

In addition, to install a coaxial cable to the conventional end connectors, it may require professional crimping tools, which may result in extra costs for installation.

Thus, there still is a need in the art to address the aforementioned deficiencies and inadequacies.

SUMMARY OF THE INVENTION

The above-mentioned disadvantages of the prior art are overcome by the present invention, which in one aspect is a fitting member for connecting a coaxial cable having an electrically conductive member to a second electrically conductive member.

In one embodiment of the present invention, the fitting member includes a connector body that has a first end, an opposite second end, a cylindrical body defined between the first end and the second end, and an annular recess formed on an outer surface of the cylindrical body proximate to the second end. The fitting member further includes an outer tube having a first end and an opposite second end defining a body therebetween, and a clamp head inwardly projecting away from the first end, wherein the body has an outer diameter, $d_1$, and is sized to fit into the first end of the connector body by the second end.

The fitting member also includes an inner tube having a neck portion, a first shoulder extending from the neck portion, a second shoulder extending from the first shoulder and a sleeve extending from the second shoulder, which defines a tube body. The second shoulder has a diameter sized to engage with the clamp head of the outer tube. The first shoulder has a diameter greater than the diameter of the second shoulder so as to form a first step at the junction of the first shoulder and the second shoulder for limiting the axial motion of the clamp head. And the tube body has an inner diameter, $d_0$, and is sized to receive a free end of the electrically conductive member of the coaxial cable therethrough.

Furthermore, the fitting member includes a sleeve tube insertable into the connector body for holding the coaxial cable. The sleeve tube comprises a sleeve, a sleeve tip and a plurality of annular serrations sequentially formed on an inner surface thereof. The sleeve tube is made of plastic in one embodiment of the present invention.

Moreover, the fitting member includes a connector head having a neck portion, a body extending from the neck portion, and a clamp ring inwardly projecting away from an inner surface of the body at a predetermined position. The clamp ring of the connector head is sized to fit to the first shoulder of the inner tube such that the connector head is rotatable around an axis of the inner tube. The exterior of the connector head body is formed with a plurality of hexagonal surfaces.

Additionally, the fitting member includes a first sealing member and a second sealing member. The first sealing member is positioned therebetween the neck portion of the inner tube and an inner surface of the body of the connector head. The second sealing member is positioned therebetween the first shoulder of the inner tube and an inner surface of the body of the connector head. The second sealing member is further positioned therebetween the first end of the outer tube and the clamp ring of the connector head. Each of the first sealing member and the second sealing member is an O-ring.

The connector body of the fitting member further includes an inner conical portion that is proximate to the second end and extends toward to the second end from a first diameter at least as great as the outer diameter, $d_1$, of the outer tube to a second diameter, $d_2$, less than the outer diameter, $d_1$, of the outer tube. The second diameter $d_2$ substantially corresponds to an outer diameter of the coaxial cable.

The inner tube of the fitting member also has a flange outwardly projecting away from the junction of the neck portion and the first shoulder. The flange has a diameter greater than either of the diameter of the first shoulder and a diameter of the neck portion so as to form a second step at the junction of the first shoulder and the flange for limiting the axial motion of the clamp ring of the connector head, and a third step at the junction of the flange and the neck portion for partially receiving the first sealing member.

In another aspect, the present invention relates to a fitting member for connecting a coaxial cable having an electrically conductive member to a second electrically conductive member. In one embodiment of the present invention, the fitting member includes a connector body that has a first end, an opposite second end, a cylindrical body defined between the first end and the second end, and an annular groove formed on an inner surface of the cylindrical body proximate to the first end.

Furthermore, the fitting member includes an outer tube. The outer tube has a cylindrical body that has an inner diameter sized to receive a free end of the coaxial cable therein and an outer diameter, $D_1$, and is sized to fit into the interior space defined by the cylindrical body of the connector body. The outer tube also has a neck portion extending from the cylindrical body. The outer tube further has an annular bulge outwardly projecting away from an outer surface of the cylindrical body at a predetermined position such that when the outer tube is inserted into the connector body from the first end of the connector body, the bulge is received in and engaged with the groove of the connector body so as to limit the relative axial motion of the connector body and the outer tube.

Moreover, the fitting member includes a sleeve tube insertable into the connector body for holding the coaxial cable. The sleeve tube has a sleeve body, a sleeve tip and a plurality of annular bulges sequentially formed on an inner surface thereof. The sleeve tube is made of plastic according to one embodiment of the present invention.

Additionally, the fitting member includes an inner tube having a clamp head, a shoulder extending from the clamp head and a sleeve extending from the shoulder forming a tube body for receiving a free end of the electrically conductive member of the coaxial cable therethrough. The inner tube shoulder has a diameter substantially corresponding to an inner diameter of the neck portion of the outer tube so as to engage with the neck portion when the inner tube is inserted into the outer tube.

The fitting member further includes a connector head having a neck portion, a body extending from the neck portion, and a clamp ring extending from the body, wherein the clamp ring has a diameter less than an inner diameter of the body and is sized to fit to the neck portion of the outer tube such that the connector head is rotatable around an axis of the outer tube. The exterior of the body is formed with a plurality of hexagonal surfaces according to one embodiment of the present invention.

The fitting member also includes a sealing member positioned on the clamp head of the inner tube. The sealing member is an O-ring in one embodiment of the present invention.

The connector body of the fitting member further includes an inner conical portion that is proximate to the second end and extends toward to the second end from a first diameter at least as great as the outer diameter, $D_1$, of the outer tube to a second diameter, $D_2$, less than the outer diameter, $D_1$, of the outer tube. The second diameter $D_2$ substantially corresponds to an outer diameter of the coaxial cable.

In yet another aspect, the present invention relates to a fitting member for connecting a coaxial cable having an electrically conductive member to a second electrically conductive member. According to one embodiment of the present invention, the fitting member includes a connector body and an outer tube mounted to the connector body. Furthermore, the fitting member includes an inner tube having a tube body for receiving a free end of the electrically conductive member of the coaxial cable therethrough. The inner tube body has a neck portion, a flange extending from the neck portion, a first shoulder extending from the flange, and a second shoulder extending from the first shoulder for engaging with the outer tube. The inner tube body further has a first step formed at the junction of the second shoulder and the first shoulder so as to limit the axial motion of the outer tuber, a second step formed at the junction of the first shoulder and the flange, and a third step formed at the junction of flange and the neck portion. Moreover, the fitting member includes a sleeve tube insertable into the connector body for holding the coaxial cable. Additionally, the fitting member includes a sealing member that is at least partially received by the third step and the neck portion.

These and other aspects will become apparent from the following description of the preferred embodiment taken in conjunction with the following drawings, although variations and modifications therein may be affected without departing from the spirit and scope of the novel concepts of the disclosure.

DETAILED DESCRIPTION OF THE INVENTION

Figure 1:
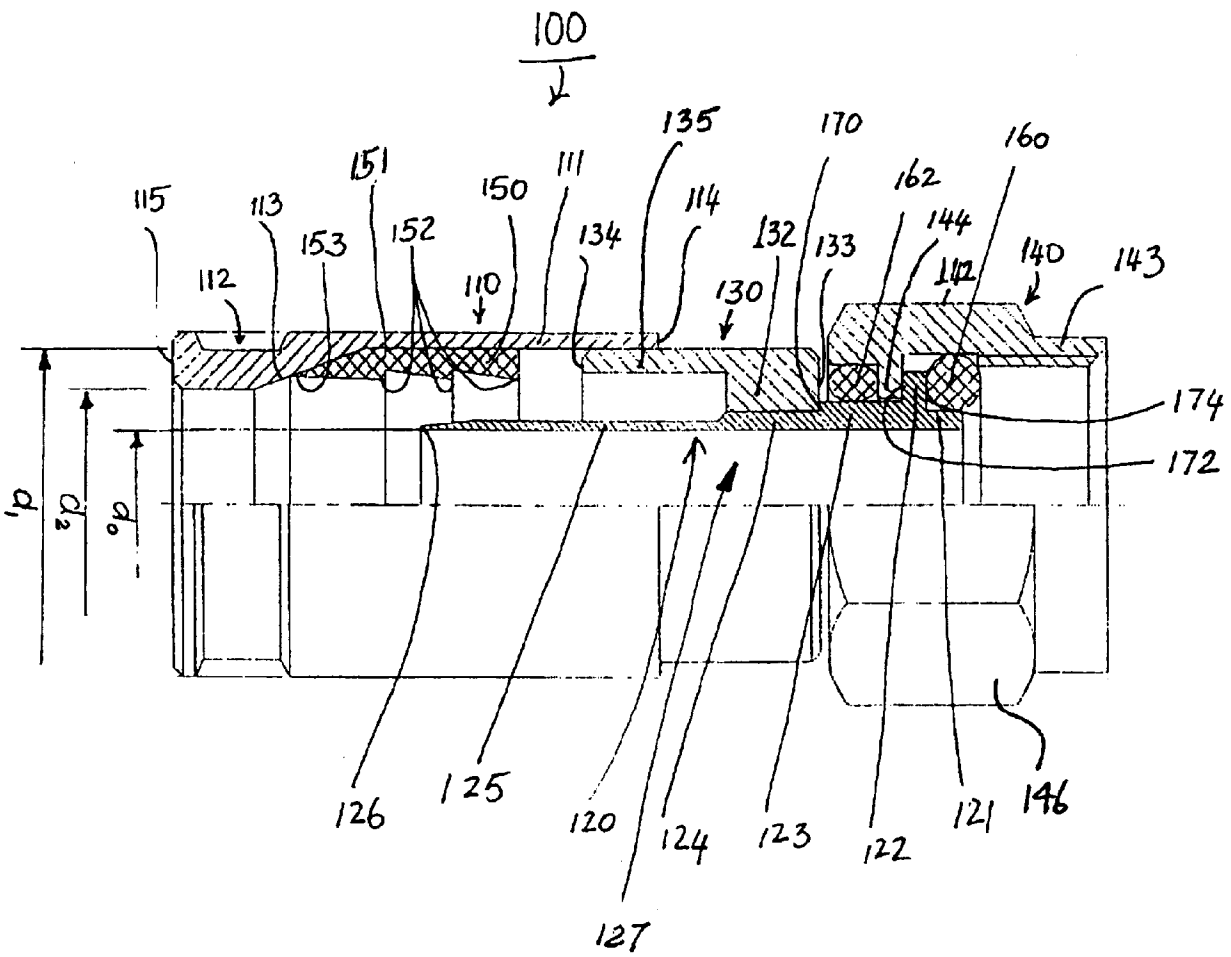
FIG. 1 shows a partial side cross-sectional view of a fitting member according to one embodiment of present invention.

The present invention is more particularly described in the following examples that are intended to be illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings. In accordance with the purposes of this invention, as embodied and broadly described herein, this invention, in one aspect, relates to a fitting member for connecting a coaxial cable having an electrically conductive member to a second electrically conductive member.

Figure 2:
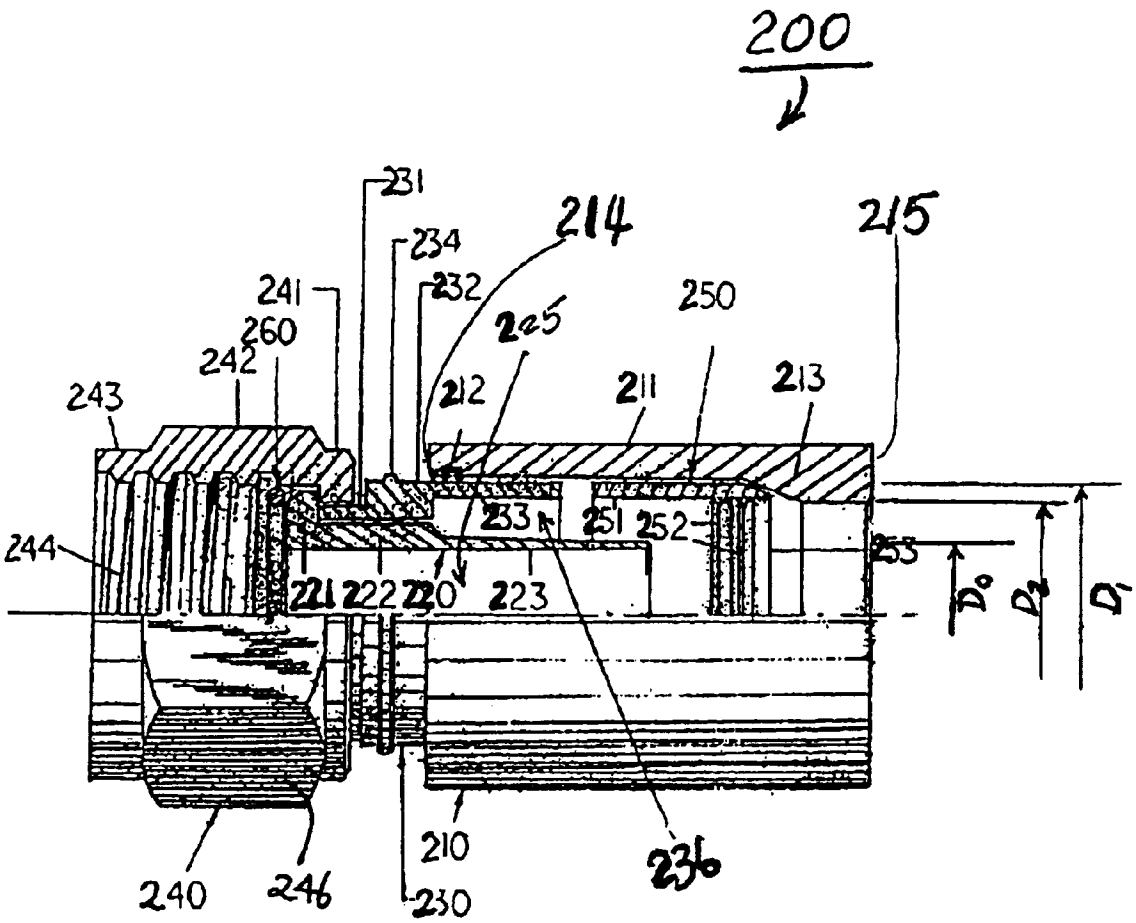
FIG. 2 shows a partial side cross-sectional view of a fitting member according to another embodiment of present invention.
Figure 3:
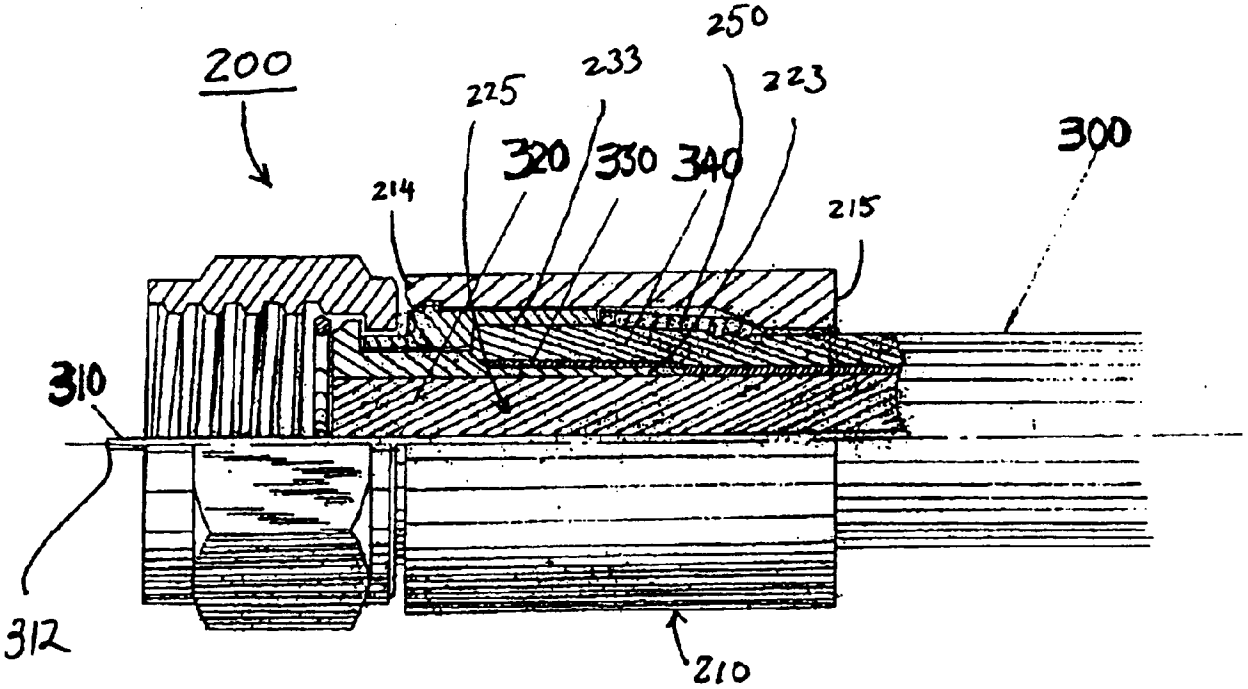
FIG. 3 shows a partial side cross-sectional view of the fitting member as shown in FIG. 2, crimped with a free end of a coaxial cable.

Referring first to FIGS. 1-3, a fitting member 100 according to one embodiment of the present invention is shown in FIG. 1, and a fitting member 200 according to another embodiment of the present invention is shown in FIGS. 2 and 3, respectively. In particular, as shown in FIG. 3, the fitting member 200 is with a coaxial cable 300 installed, where the coaxial cable 300 includes a center conductor 310 that is electrically conductive, a braided conductor 330, a dielectric insulator 320 therebetween the center conductor 310 and the braided conductor 330, and an outer jacket 340 encasing the braided conductor 330.

Now referring to FIGS. 1 and 3, and mainly to FIG. 1, the fitting member 100 in one embodiment includes a connector body 110. The connector body 110 has a first end 114, an opposite second end 115, a cylindrical body 111 defined between the first end 114 and the second end 115. The connector body 110 also includes an annular recess 112 that is formed on an outer surface of the cylindrical body 111 and proximate to the second end 115.

The fitting member 100 also includes an outer tube 130 that has a first end 133 and an opposite second end 134 defining a body 135 therebetween and a clamp head 132 inwardly projecting away from the first end 133. The outer tube body 135 has an outer diameter, $d_1$, and is sized to fit into the first end 114 of the connector body 110 by the second end 134 of the outer tube 130.

Furthermore, the fitting member 100 includes an inner tube 120. The inner tube 120 has a neck portion 121, a first shoulder 123 extending from the neck portion 121, a second shoulder 124 extending from the first shoulder 123 and a sleeve 125 extending from the second shoulder 124, which defines a tube body 127. The second shoulder 124 of the inner tube 120 has a diameter sized to engage with the clamp head 132 of the outer tube 130. The first shoulder 123 of the inner tube 120 has a diameter greater than the diameter of the second shoulder 124 so as to form a first step 170 at the junction of the first shoulder 123 and the second shoulder 124 for limiting the axial motion of the clamp head 132. The tube body 127 of the inner tube 120 has a diameter, $d_0$, and is sized to receive a free end of the center conductor 310 that is the electrically conductive of the coaxial cable 300 therethrough. The inner tube 120 further has a flange 122 outwardly projecting away from the first shoulder 123. The flange 122 of the inner tube 120 has a diameter greater than either of the diameter of the first shoulder 123 and a diameter of the neck portion 121 so as to form a second step 172 at the junction of the first shoulder 123 and the flange 122 for limiting the axial motion of the clamp ring 144 of the connector head 140, and a third step 174 at the junction of the flange 122 and the neck portion 121 for partially receiving a first sealing member 160, which is discussed in more details below.

Moreover, the fitting member 100 includes a sleeve tube 150, which has a sleeve body 151, a sleeve tip 153 and a plurality of annular serrations 152 sequentially formed on an inner surface thereof. The sleeve tube 150 is sized to fit into the connector body 110 for holding the coaxial cable 300. The plurality of annular serrations 152 may further enhance the engagement between the sleeve tube 150 and the coaxial cable 300.

Additionally, the fitting member 100 includes a connector head 140 that has a neck portion 143, a body 142 extending from the neck portion 143, and a clamp ring 144 inwardly projecting away from an inner surface of the body 142 at a predetermined position. The clamp ring 144 of the connector head 140 is sized to fit to the first shoulder 123 of the inner tube 120 such that the connector head 140 is rotatable around an axis of the inner tube 120. The exterior of the body 142 is formed with a plurality of hexagonal surfaces 146, which provide means for easy holding and/or handling.

The fitting member 100 further includes a first sealing member 160 and a second sealing member 162 for sealing moisture and dusts off the center conductor 310 that is electrically conductive of the coaxial cable 300. Each of the first sealing member 160 and the second sealing member 162 has an O-ring according to one embodiment of the present invention. The first sealing member 160 is positioned therebetween the neck portion 121 of the inner tube 120 and an inner surface of the body 142 of the connector head 140. The second sealing member 162 is positioned therebetween the first shoulder 123 of the inner tube 120 and an inner surface of the body 142 of the connector head 140, respectively. The second sealing member 162 is further positioned therebetween the first end 133 of the outer tube 130 and the clamp ring 144 of the connector head 140.

The connector body 110 of the fitting member 100 further has an inner conical portion 113 proximate to the second end 115 and extending toward to the second end 115 from a first diameter at least as great as the outer diameter, $d_1$, of the outer tube 130 to a second diameter, $d_2$, which is less than the outer diameter, $d_1$, of the outer tube 130. The second diameter $d_2$ substantially corresponds to an outer diameter of the coaxial cable 300. The sleeve tube 150 is inserted into the connector body 110 such that the sleeve tip 153 is proximate to the first diameter $d_1$ of the inner conical portion 113 of the connector body 110.

As shown in FIG. 1, the fitting member 100 is assembled such that the second shoulder 124 of the inner tube 120 is tightly fitted with the clamp head 132 of the outer tube 130. The second end 134 of the outer tube 130 is then tightly fitted into the first end 114 of the connector body 110. The clamp ring 144 of the connector head 140 is loosely fitted to the first shoulder 122 of the inner tube 120 so that the connector head 140 is rotatable around an axis of the inner tube 120. The first sealing member 160, such as an O-ring, is received by the neck portion 121 and the third step 174 of the inner tube 120, and the inner surface of the connector head 140, respectively. The second sealing member 162, such as an O-ring, is partially received by the first shoulder 123 of the inner tube 120 and the inner surface of the connector head 140. The second sealing member 162 is further partially received by the second step 172 of the inner tube 120 and the first end 133 of the outer tube 130. The sleeve tube 150 is inserted into the connector body 110 and positioned between the second end 134 of the outer tube 130 and the first diameter $d_1$ of the conical portion 113 of the connector body 110.

The inner tube 120 and the outer tube 130 can be made from conductive materials including metals or alloys such as copper, aluminum, zinc alloy or a combination of them. The connector body 110 and the connector head 140 can be made from conductive materials including metals or alloys such as copper, aluminum, zinc alloy or a combination of them. The sleeve tube 150 can be made from non-conductive materials such as plastics or conductive materials such as aluminum. And the first sealing member 160 and the second sealing member 162 are made from an insulative material such as rubber.

Now referring to FIGS. 2 and 3, a fitting member 200 for connecting a coaxial cable 300 having an electrically conductive member to a second electrically conductive member according to another embodiment of the present invention includes a connector body 210 that has a first end 214, an opposite second end 215, a cylindrical body 211 defined between the first end 214 and the second end 215, and an annular groove 212 formed on an inner surface of the cylindrical body 211 and proximate to the first end 214.

The fitting member 200 further includes an outer tube 230. The outer tube 230 has a cylindrical body 236, where the cylindrical body 236 has an inner diameter sized to receive a free end of the coaxial cable 300 therein and an outer diameter, $D_1$, and is sized to fit into the interior space that is defined by the cylindrical body 211 of the connector body 210. The outer tube 230 also has a neck portion 231 extending from the cylindrical body 236. The outer tube 230 further has an annular bulge 234 outwardly projecting away from an outer surface of the cylindrical body 236 at a predetermined position such that when the outer tube 230 is inserted into the connector body 210 from the first end 214, the bulge 234 is received in and engaged with the groove 212 of the connector body 210 so as to limit the relative axial motion of the connector body 210 and the outer tube 230.

The fitting member 200 also includes a sleeve tube 250 that is insertable into the connector body 210 for holding the coaxial cable 300. The sleeve tube 250 has a sleeve body 251, a sleeve tip 253 and a plurality of annular bulges 252 sequentially formed on an inner surface thereof. The plurality of annular serrations 252 may further enhance the engagement between the sleeve tube 250 and the coaxial cable 300.

Furthermore, the fitting member 200 includes an inner tube 220 that has a clamp head 221, a shoulder 222 extending from the clamp head 221 and a sleeve 223 extending from the shoulder 222, which forms a tube body 225. The tube body 225 of the inner tube 220 is adapted for receiving a free end of the center conductor 310 that is electrically conductive of the coaxial cable 300 therethrough. The shoulder 222 of the inner tube 220 has a diameter substantially corresponding to an inner diameter of the neck portion 231 of the outer tube 230 so as to engage with the neck portion 231 when the inner tube 220 is inserted into the outer tube 230.

Moreover, the fitting member 200 includes a connector head 240 having a neck portion 243, a body 242 extending from the neck portion 243, and a clamp ring 241 extending from the body 242. The clamp ring 241 of the connector head 240 has a diameter less than an inner diameter of the body 242 and is sized to fit to the neck portion 231 of the outer tube 230 such that the connector head 240 is rotatable around an axis of the outer tube 230. The exterior of the body 242 is formed with a plurality of hexagonal surfaces 246, which provide means for easy holding and/or handling.

Additionally, the fitting member 200 includes a sealing member 260 that is positioned on the clamp head 221 of the inner tube 220 such that when the fitting member 200 is connected to the second electrically conductive member, the sealing member 260 seals moisture and dusts off the electrically conductive members. In one embodiment, the sealing member 260 comprises an O-ring.

The connector body 210 of the fitting member 200 further has an inner conical portion 213 proximate to the second end 215 and extending toward to the second end 215 from a first diameter at least as great as the outer diameter, $D_1$, of the outer tube 230 to a second diameter, $D_2$, which is less than the outer diameter, $D_1$, of the outer tube 230. The second diameter $D_2$ substantially corresponds to an outer diameter of the coaxial cable 300.

Referring now to FIGS. 2 and 3, a fitting member 200 is assembled according to one embodiment. The shoulder 222 of the inner tube 220 is tightly fitted with an inner surface of the neck portion 231 of the outer tube 230. The outer tube 230 is fitted into the connector body 210 from the first end 214 of the connector body 210 such that the bulge 234 of the outer tube 230 is received in and engaged with the groove 212 of the connector body 210. The clamp ring 241 of the connector head 240 is loosely fitted to an outer surface of the neck portion 231 of the outer tube 230 so that the connector head 240 is rotatable around an axis of the outer tube 230. The sealing member 260, such as an O-ring, is positioned on the clamp head 221 of the inner tube 220 such that when the fitting member 200 is connected to the second electrically conductive member such as a proper component of the coaxial cable 300, the sealing member 260 seals moisture and dusts off the electrically conductive members. The sleeve tube 250 is inserted into the connector body 210 and positioned between the end of the sleeve 233 of the outer tube 230 and the first diameter $D_1$ of the conical portion 213 of the connector body 210.

The inner tube 220 and the outer tube 230 can be made from conductive materials including metals or alloys such as copper, aluminum, zinc alloy or a combination of them. The connector body 210 and the connector head 240 can be made from conductive materials including metals or alloys such as copper, aluminum, zinc alloy or a combination of them. The sleeve tube 250 can be made from non-conductive materials such as plastics or conductive materials such as aluminum. And the sealing member 260 is made from an insulative material such as rubber.

Figure 4:
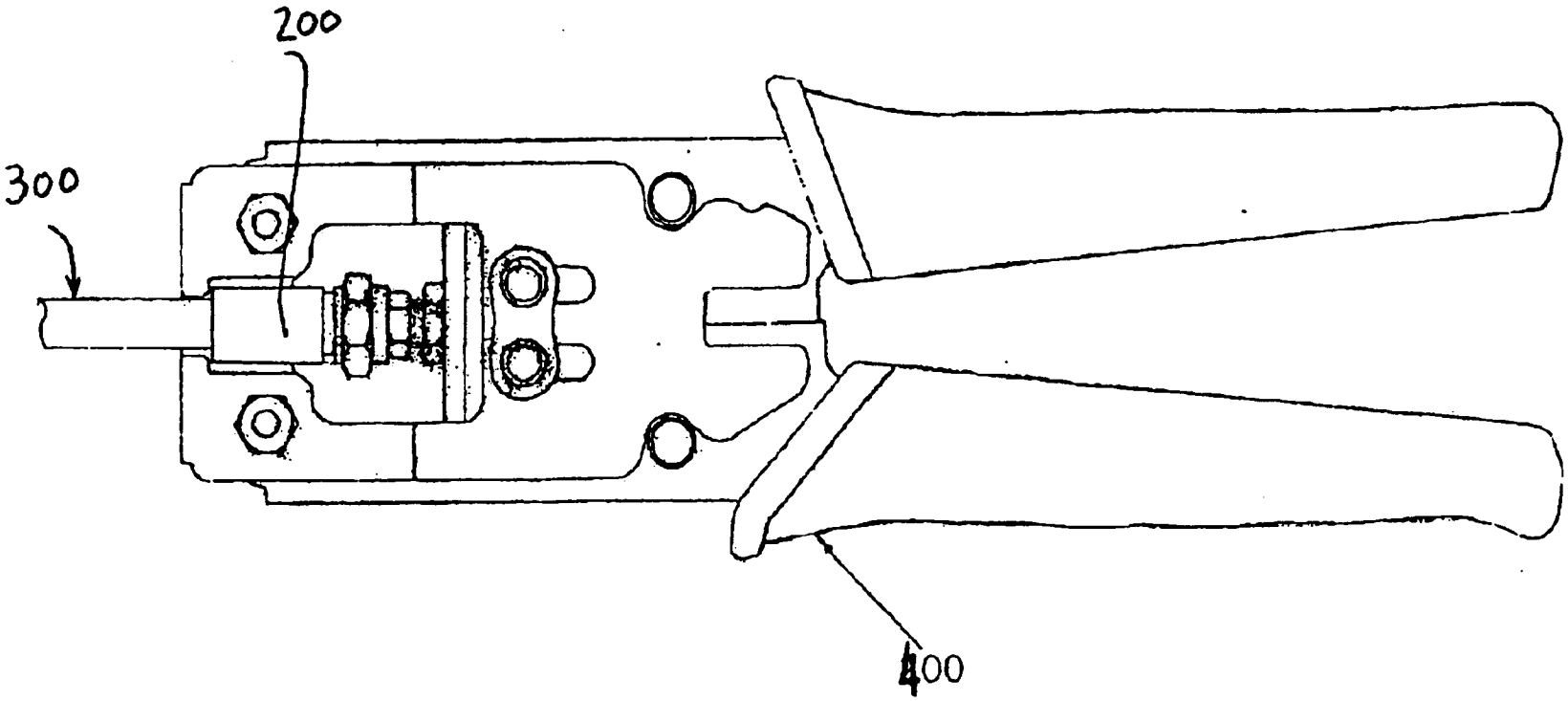
FIG. 4 shows a side view of a crimping tool for crimping a coaxial cable to a fitting member according to one embodiment of the present invention.

Referring now to FIGS. 3 and 4, in particular to FIG. 3, during the fitting member installations, an free end of the coaxial cable 300 is prepared by removing a first length of the outer jacket 340 and the braided conductor 330 from the free end of the coaxial cable 300 and then removing a second length of the dielectric insulator 320 from the free end of the coaxial cable 300, where the second length is shorter than the first length so as to expose an end of the center conductor 310.

As shown in FIG. 3, the prepared free end of the coaxial cable 300 is pushed into the fitting member 200 from the second end 215 of the connector body 210. As a result, the center conductor 310 and the dielectric insulator 320 of the coaxial cable 300 are received by the inner tube body 225 of the inner tube 220 therethrough and the exposed end 312 of the center conductor 310 of the coaxial cable 300 is further extended out of the connector head 240. The braided conductor 330 of the coaxial cable 300 is received by an outer surface of the sleeve 223 of the inner tube 220. The outer jacket 340 of the coaxial cable 300 is received by an inner surface of the outer tube 230 and an inner surface of the sleeve tube 250, respectively. The annular bulge 252 of the sleeve tube 250 is then embedded into the outer jacket 340 of the coaxial cable 300 to reinforce mechanical strength so as to prevent the coaxial cable 300 from being pulled out from the fitting member 200. A crimp tool 400 is used to press both sides of the fitting member 200, as shown in FIG. 4.

While there has been shown several and alternate embodiments of the present invention, it is to be understood that certain changes can be made in the form and arrangement of the elements of the device as would be know to one skilled in the art without departing from the underlying scope of the invention as is discussed and set forth above. Furthermore, the embodiments described above are only intended to illustrate the principles of the present invention and are not intended to limit the scope of the invention to the disclosed elements.

What is claimed is:

1. A fitting member for connecting a coaxial cable having an electrically conductive member to a second electrically conductive member, comprising:

a. a connector body having a first end, an opposite second end, a cylindrical body defined between the first end and the second end, and an annular recess formed on an outer surface of the cylindrical body proximate to the second end;

b. an outer tube having a first end and an opposite second end defining a body therebetween and a clamp head inwardly projecting away from the first end, wherein the body has an outer diameter, $d_1$, and is sized to fit into the first end of the connector body by the second end of the outer tube;

c. an inner tube having a neck portion, a first shoulder extending from the neck portion, a second shoulder extending from the first shoulder and a sleeve extending from the second shoulder defining a tube body, wherein the second shoulder has a diameter sized to engage with the clamp head of the outer tuber, and the first shoulder has a diameter greater than the diameter of the second shoulder so as to form a first step at the junction of the first shoulder and the second shoulder for limiting the axial motion of the clamp head, and the tube body has an inner diameter, $d_0$, and is sized to receive a free end of the electrically conductive member of the coaxial cable therethrough; and d. a sleeve tube insertable into the connector body for holding the coaxial cable, wherein the inner tube further comprises a flange outwardly projecting away from the junction of the neck portion and the first shoulder, the flange having a diameter greater than either of the diameter of the first shoulder and a diameter of the neck portion so as to form a second step at the junction of the first shoulder and the flange for limiting the axial motion of the clamp ring of the connector head, and a third step at the junction of the flange and the neck portion for partially receiving the first sealing member.

2. A fitting member for connecting a coaxial cable having an electrically conductive member to a second electrically conductive member, comprising:

a. a connector body having a first end, an opposite second end, a cylindrical body defined between the first end and the second end, and an annular recess formed on an outer surface of the cylindrical body proximate to the second end;

b. an outer tube having a first end and an opposite second end defining a body therebetween and a clamp head inwardly projecting away from the first end, wherein the body has an outer diameter, $d_1$, and is sized to fit into the first end of the connector body by the second end of the outer tube;

c. an inner tube having a neck portion, a first shoulder extending from the neck portion, a second shoulder extending from the first shoulder and a sleeve extending from the second shoulder defining a tube body, wherein the second shoulder has a diameter sized to engage with the clamp head of the outer tuber, and the first shoulder has a diameter greater than the diameter of the second shoulder so as to form a first step at the junction of the first shoulder and the second shoulder for limiting the axial motion of the clamp head, and the tube body has an inner diameter, $d_0$, and is sized to receive a free end of the electrically conductive member of the coaxial cable therethrough; and d. a sleeve tube insertable into the connector body for holding the coaxial cable, wherein the sleeve tube comprises a sleeve body, a sleeve tip and a plurality of annular serrations sequentially formed on an inner surface thereof.

3. The fitting member of claim 2, wherein the sleeve tube is made of plastic.

4. A fitting member for connecting a coaxial cable having an electrically conductive member to a second electrically conductive member, comprising:

a. a connector body having a first end, an opposite second end, a cylindrical body defined between the first end and the second end, and an annular groove formed on an inner surface of the cylindrical body and proximate to the first end;

b. an outer tube having a cylindrical body, wherein the cylindrical body has an inner diameter sized to receive a free end of the coaxial cable therein and an outer diameter, $D_1$, and is sized to fit into the interior space defined by the cylindrical body of the connector body, a neck portion extending from the cylindrical body, and an annular bulge outwardly projecting away from an outer surface of the cylindrical body at a predetermined position such that when the outer tube is inserted into the connector body from the first end, the bulge is received in and engaged with the groove of the connector body so as to limit the relative axial motion of the connector body and the outer tube; and c. a sleeve tube insertable into the connector body for holding the coaxial cable, wherein the sleeve tube comprises a sleeve body, a sleeve tip and a plurality of annular bulges sequentially formed on an inner surface thereof.

5. The fitting member of claim 4, wherein the sleeve tube is made of plastic.

6. A fitting member for connecting a coaxial cable having an electrically conductive member to a second electrically conductive member, comprising:

a. a connector body;

b. an outer tube mounted to the connector body;

c. an inner tube having a tube body for receiving a free end of the electrically conductive member of the coaxial cable therethrough, wherein the tube body comprises a neck portion, a flange extending from the neck portion, a first shoulder extending from the flange, a second shoulder extending from the first shoulder for engaging with the outer tube, a first step formed at the junction of the second shoulder and the first shoulder so as to limit the axial motion of the outer tube, a second step formed at the junction of the first shoulder and the flange, and a third step formed at the junction of flange and the neck portion; and d. a sleeve tube insertable into the connector body for holding the coaxial cable.

7. The fitting member of claim 6, further comprising a sealing member that is at least partially received by the third step and the neck portion.

* * * * *

UNITED STATES PATENT AND TRADEMARK OFFICE

CERTIFICATE OF CORRECTION

PATENT NO. : 6,817,897 B2
DATED : November 16, 2004
INVENTOR(S) : Alexander B. Chee It is certified that error appears in the above-identified patent and that said Letters Patent is hereby corrected as shown below:

Title page,
Insert Item:
-- [73] Assignee: Pro Brand International, Inc., Marietta, GA --.

Signed and Sealed this

Seventeenth Day of January, 2006

JON W. DUDAS
*Director of the United States Patent and Trademark Office*